United States Patent [19]

Campbell et al.

[11] 4,350,843

[45] * Sep. 21, 1982

[54] METHOD AND SYSTEM FOR CRIMPING A METAL CONNECTOR

[75] Inventors: Paul K. Campbell; Edward L. Nichols, III, both of Birmingham, Ala.

[73] Assignee: Square D Company, Palatine, Ill.

[ * ] Notice: The portion of the term of this patent subsequent to Aug. 21, 1996, has been disclaimed.

[21] Appl. No.: 938,744

[22] Filed: Aug. 31, 1978

[51] Int. Cl.[3] ..... H01R 5/08

[52] U.S. Cl. ..... 174/94 R; 174/84 C; 403/274; 403/391

[58] Field of Search ..... 174/71 R, 84 C, 90, 174/94 R; 403/274, 389, 391

[56] References Cited

U.S. PATENT DOCUMENTS 3,354,517 11/1967 Levinsky ..... 174/94 R 4,165,148 8/1979 Campbell et al. ..... 174/94 R X

*Primary Examiner*—Roy N. Envall, Jr.

*Attorney, Agent, or Firm*—Carmen B. Patti; John R. Garrett; Richard T. Guttman

[57] ABSTRACT

This disclosure depicts a novel method and system for crimping an elongated malleable metal connector onto two cables or the like and deforming the connector so that in its final crimped condition it is of generally a semi-cruciform/semi-circular shape in transverse cross-section with offset tap cable lodgment. The method comprises placing the connector between first and second opposed pairs of crimping dies, the first pair each having a nose portion for biting into a tap portion of the connector and one of said second pair also having a nose portion for biting into the tap portion of the connector and the other of the second pair has a nest die for crimping a main portion of the connector; moving the dies simultaneously toward one another for gripping the connector at four locations spaced around the connector; applying pressure to the dies to cause them to crimp the connector and effect deformation of the connector to the generally semi-cruciform/semi-circular shape with offset tap cable lodgment, each of the dies being substantially equidistant from its respective two adjacent dies throughout the simultaneous movement thereof; and relasing the dies when an increase in pressure of the dies on the connector reaches a predetermined value, independent of the extent of die movement, thereby terminating the crimping operation. Apparatus is disclosed for implementing the described method.

1 Claim, 12 Drawing Figures

FIG.2
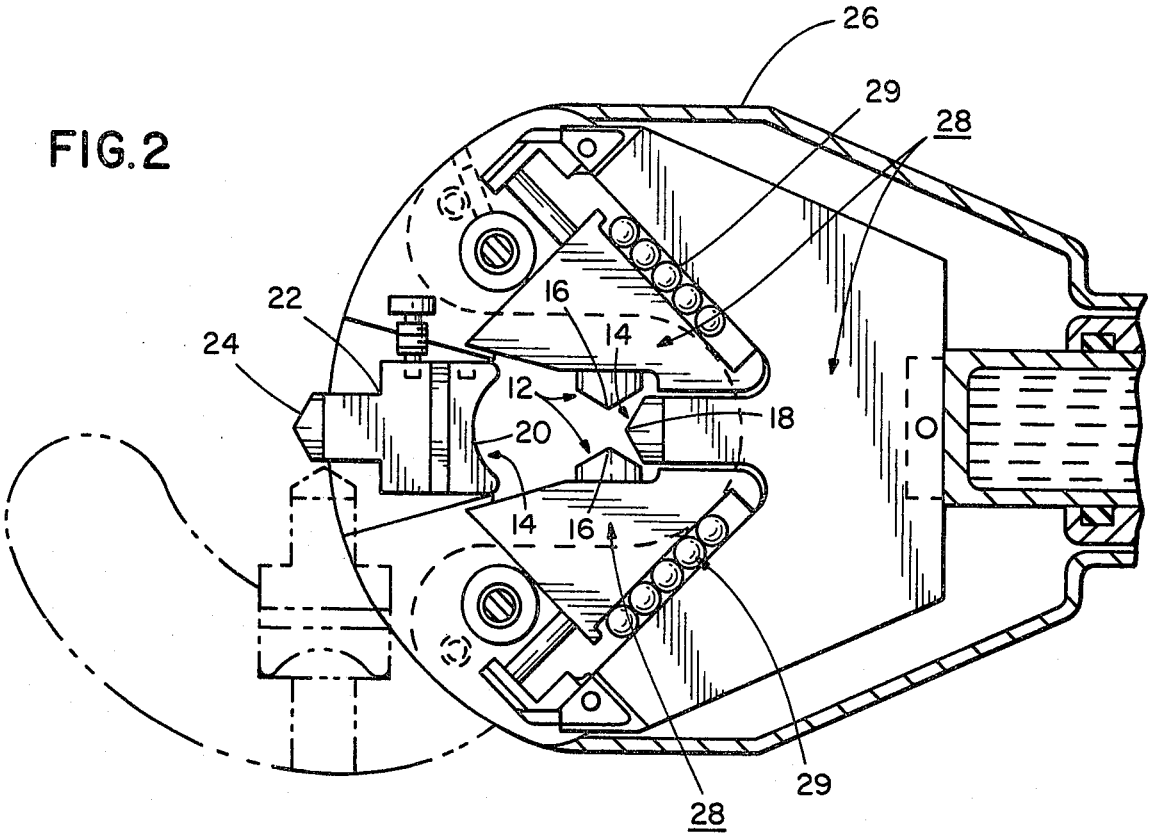
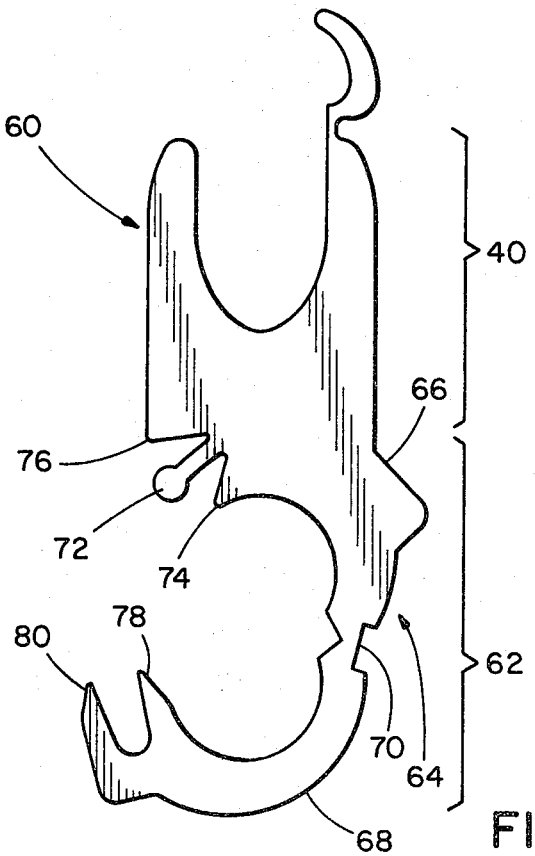
FIG.3A
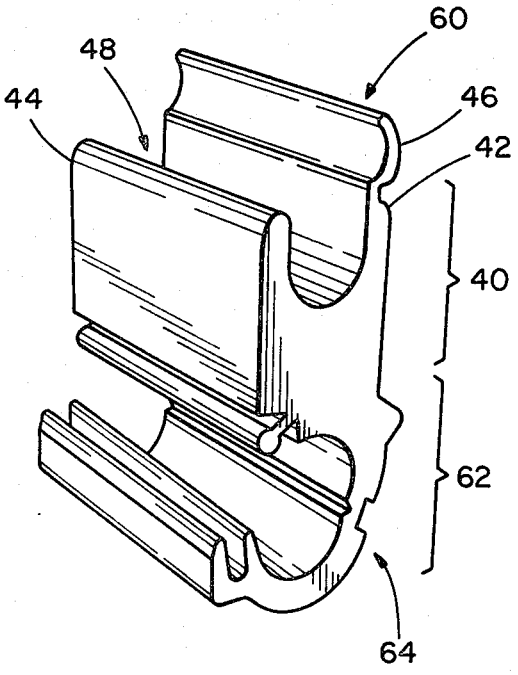
FIG.3B

METHOD AND SYSTEM FOR CRIMPING A METAL CONNECTOR

CROSS-REFERENCE TO RELATED APPLICATIONS

This application relates to but is no way dependent upon copending application of common ownership Ser. No. 925,737, filed July 19, 1978.

BACKGROUND OF THE INVENTION AND PRIOR ART STATEMENT

This invention relates in general to a method and system for crimping an elongated malleable metal connector onto two cables or the like, and in particular to deforming the connector so that in its final crimped condition it is of a generally semi-cruciform/semi-circular shape in transverse cross-section.

Conventional crimping devices available in the art, particularly in the electrical industry, have had several serious short comings. The prior art devices for the most part have been of three basic types; a one hand or plyer type, a two hand bolt cutter, and a two hand hydraulic type. The one hand or plyer type generally contains integral dies for a given external connector configuration while the bolt cutter and hydraulic types generally have provisions for interchangeable dies for any given external connector configuration. Prior devices for the most part have therefore been dependent on the multiplicity of die and connector sizes for compression of a narrow range of conductor sizes. In addition, the tools of the prior art which have provided a four way crimp are limited as to the wire sizes they can crimp in a single piece, parallel tap connector. Correspondently, this necessitates the use of independently crimped main and tap grooves for many popular conductor sizes. This limitation results in connector designs which cause an increase in installation time due to the independent crimping of the main and tap portions of the connectors.

A unique compression tool is disclosed in U.S. Pat. No. 3,154,981 issued to McDurmont. This patent discloses a tool having a head with four opposed crimping dies aligned with a common center. When a connector is placed between the dies the dies move inward and crimp the connector about a cable. A cross-section of the crimped connector is of a general cruciform shape. The unique tool is suitable for compressing single connectors about a single cable, however, there exists a need for crimping a connector having two portions, such as two parallel cylinders, about two cables. This is needed in the case where a tap line is connected to a main continuous conductor. The present invention provides a novel compression tool which is an improvement of a compression tool disclosed in U.S. Pat. No. 3,154,981. The following U.S. patents illustrate aspects of the prior art which have been discussed above:

| | | | |
|---|---|---|---|
| 3,871,224 | 2,838,970 | 3,423,987 | 2,900,854 |
| 3,051,213 | 3,212,317 | 1,359,013 | 2,814,222 |
| 2,762,414 | 3,199,336 | 3,919,877 | 3,576,122 |
| 3,031,001 | 3,871,224 | | |

The relevance of the prior art indicated in the present specification should not be given a limited interpretation. A cited prior art item may be found to have relevance in a passage other than the one referred to, or to have relevance in a sense different than as stated.

OBJECTS OF THE INVENTION

It is a general object of the present invention to provide an improved method and system for crimping an elongated malleable metal connector onto two cables or the like.

It is another object of the present invention to increase the number of wire sizes which can be connected in a given compressible connector.

It is yet another object to provide a method and system for simultaneously crimping the main and tap portions of a connector.

It is a further object of the present invention to provide a method and system for crimping connectors which save in installation time resulting from the simultaneously crimping of the main and tap wires.

It is another object of the present invention to provide an apparatus for crimping metal connectors which has no interchangeable dies for different cable sizes.

It is still another object of the present invention to provide an system for compressing a connector in such a way as to maintain a predetermined degree of compression on the main cable while allowing varying degrees of compression on the tap cable, thereby resulting in a significant increase in the wire size range of the tap cable.

BRIEF DESCRIPTION OF THE DRAWINGS

The features of the present invention which are believed to be novel are set forth with particularity in the appended claims. The invention together with further objects and advantages may best be understood by reference to the following description taken in conjunction with the accompanying drawings, in the several figures of which like reference numerals identify like elements, and in which:

FIG. 1 is a perspective view of the novel tool for crimping an elongated malleable metal connector onto two cables or the like;

FIG. 2 is an enlarged view of a portion of the FIG. 1 tool showing the crimping dies;

FIGS. 3A and 3B illustrate a novel connector for use with the FIG. 1 tool;

DESCRIPTION OF THE PREFERRED EMBODIMENT

Figure 1:
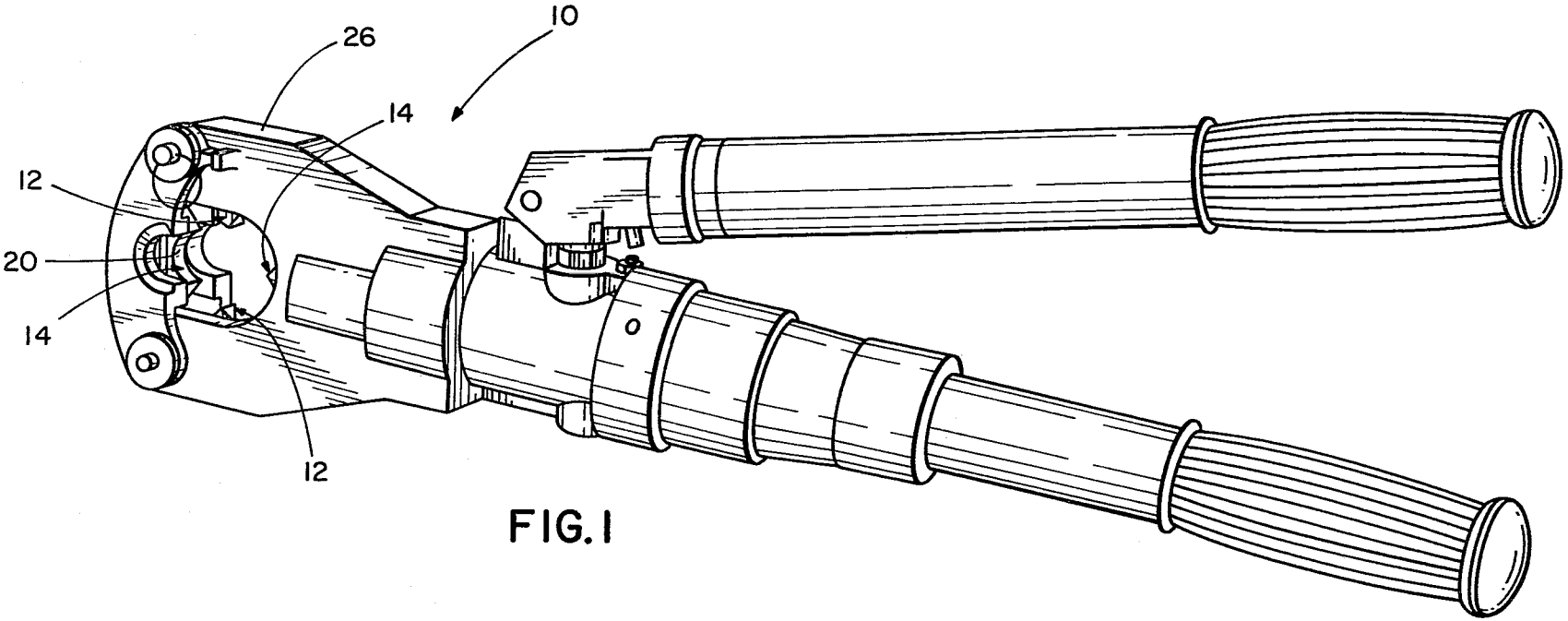

This invention relates to a novel apparatus and system for crimping an elongated malleable metal connector onto two cables or the like, and deforming the connector so that in its final crimped condition it is of generally a semi-cruciform/semi-circular shape in transverse cross-section with offset tap cable lodgment. In general terms this method comprises first placing the connector between first and second opposed pairs of crimping dies, the first pair each having a nose portion for biting into a tap portion of the connector and one of the second pair having a nose portion for also biting into the tap portion of the connector and the other of the second pair having a nest die for crimping a main portion of the connector. Secondly, the dies are moved simultaneously toward one another for gripping the connector at four locations spaced around the connector. Thirdly, pressure is applied to the dies to cause them to crimp the connector and effect deformation of the connector to the generally semi-cruciform/semi-circular shape with offset tap cable lodgment, each of the dies being substantially equidistant from its respective two adjacent dies throughout the simultaneous movement thereof. Lastly, the dies are released when an increase in pressure of the dies on the connector reaches a predetermined value, independent of the extent of die movement, thereby terminating the crimping operation.

A novel tool and connector are utilized to implement the above described method of the present invention. In general terms the tool 10 comprises:

first and second opposed pairs 12 and 14 of crimping dies or indentation dies, the first pair 12 each having a nose portion 16 for biting into a tap portion of the connector and one of the second pair 14 having a nose portion 18 for also biting into the tap portion of the connector and the other of the second pair 14 having a nest die 20 for crimping a main portion of the connector;

means 26 with all of the dies mounted thereon for relative movement toward and away from one another with the dies of the first pair 12 working in a direction generally perpendicular to the dies of the second pair 14, and with the dies being movable from an open retracted position, the connector being initially positioned between the first pair 12 and second pair 14 of the dies when the dies are in the open retracted position;

means 28 for effecting relative movement of the dies simultaneously toward one another for gripping the connector at four locations spaced around the connector and for applying pressure to the dies to cause them to crimp the connector and effect deformation of the connector to the generally semi-cruciform/semi-circular shape with offset tap cable lodgment;

means 29 for keeping each die substantially equidistant from its respective two adjacent dies throughout the simultaneous movement thereof; and means responsive to an increase in pressure of the dies on the connector to a predetermined value for automatically relieving the pressure to terminate the crimping operation independently of the extent of die movement.

A feature of the novel tool 10 is that the nest die 20 is on one side of a member 22, while opposite the nest die 20 on member 22 is an indentation die 24. The member 22 may be turned around so that indentation die 24 points inward, thereby transforming the tool into the unique crimping tool disclosed in U.S. Pat. No. 3,154,981 issued to McDurmont. The internal mechanism of the novel tool 10 is similar to that of the tool disclosed in the McDurmont patent.

Figure 4A:
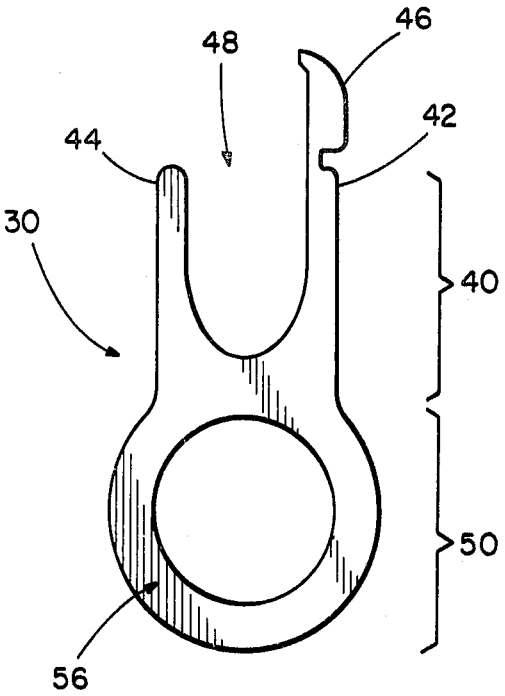
FIGS. 4A and 4B illustrate an alternative embodiment for a novel connector.
Figure 4B:
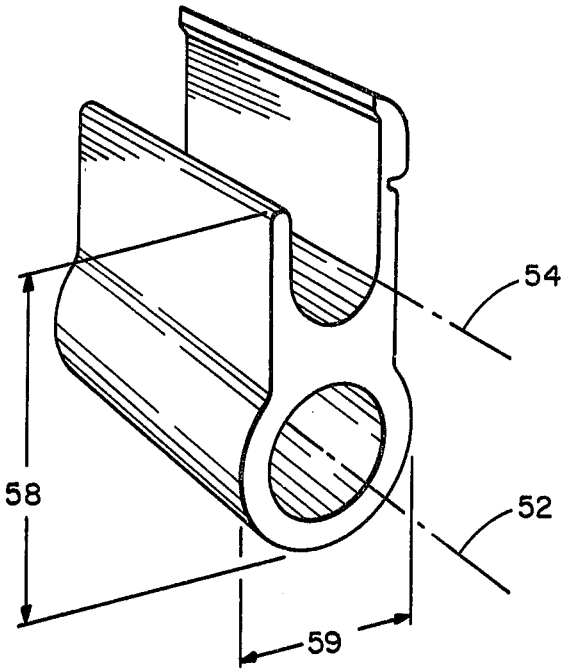

As illustrated in FIGS. 4A and 4B the novel connector 30 comprises a U-shaped main portion 40 having two legs 42 and 44. A first leg 42 of said two legs 42 and 44 has a hinged segment 46 for closing the opening 48 created by the U-shape of the main portion 40. The hinged segment 46 is initially open, and the hinged segment 46 is manually closed after transverse insertion of one of a number of different size cables. A tap portion 50, capable of being deformed to a semi-cruciform transverse cross-section with offset cable lodgment and for receiving one of a number of different size cables, is attached to the main portion 40 along the bottom of the U-shaped main portion 40, the axis 52 of the tap portion 50 being parallel to the axis 54 of the main portion 40. When the connector 30 is placed between the first and second opposed pairs 12 and 14 of crimping dies, and the dies are moved simultaneously toward one another, the first pair 12, each having a nose portion 16, bites into the tap portion 50 of the connector 30 and one of the second pair 14, having a nose portion 18, also bites into the tap portion 50 of said connector 30, and the other of the second pair 14, having a nest die 20, crimps the main portion 40 of the connector 30. Applying pressure to the dies causes the cable in the tap portion 50 to be offset towards the main portion 40 of the connector 30 (see FIGS. 5A–5D) and causes the dies to crimp the connector 30 and effect deformation of said connector 30 to a generally semi-cruciform/semi-circular shape, thereby securing the cables (see FIGS. 5A–5D).

The tap portion 50 illustrated in FIGS. 4A and 4B is substantially a tube having a wall 56 with a predetermined thickness. While applying pressure to the dies, the wall 56 deforms to provide a filler material for the offset cable lodgment. In a preferred embodiment the wall 56 has a thickness of at least 0.060 inches and the overall height 58 of the connector 30 to the overall width 59 of the tap portion 50 is a predetermined ratio in the range 1.6 to 2.4. The wall thickness and the height to width ratios are important in properly crimping a range of wire sizes with the same size connector.

Connector 60, illustrated in FIGS. 3A and 3B is an alternative embodiment in which the tap portion 62 comprises a bifurcated body member 64 having first and second leg portions 66 and 68, the outer surface of the first leg portion 66 being attached to the bottom of the U-shaped main portion 40. The first and second leg portions 66 and 68 are initially connected by a reduced cross-sectional thickness portion 70 of the body member 64 to provide a plastically flowable hinge connection. The first and second leg portions 66 and 68 define an initial predetermined angle such that the body member 64 can laterally engage an uninsulated section of an electrical cable.

The first leg 66 has on the end opposite the reduced thickness portion 70 an axially extending rib member 72 and axially extending inner and outer ridges 74 and 76 disposed on either side of the rib member 72. The second leg 68 has on the end opposite the reduced thickness portion axially extending inner and outer fingers 78 and 80. The rib member 72, the inner and outer ridges 74 and 76 and the inner and outer fingers 78 and 80 are oriented such that the outer finger 80 lies between the outer ridge 76 and the rib member 72, and the inner finger 78 lies between the inner ridge 74 and the rib member 72, when the body member 64 is closed about an uninsulated section of a cable. The enclosure occurs by pivoting of the leg members 66 and 68 about the reduced thickness portion 70 in response to hand applied external pressure. The inner and outer fingers 78 and 80 and the rib member 72 are deformed to form a positive mechanical lock when an external crimping force is applied radially to the body member 64. The first and second legs 66 and 68 form a tubular assembly and, while applying pressure to the dies, the tubular assembly deforms to provide a filler material for the offset cable lodgment.

The novel tool 10 and novel connector 30 cooperate for forming a crimping system for electrically and mechanically connecting two cables. During operation of the novel crimping system the three indention dies converge upon, indent, and key the tap portion of the connector. At the same time that the indentation dies converge toward a common center point, and they move in an upward, parallel, and colliding path with the fixed positioned, concave nest die. This movement pushes the connector into the fixed nest die, and results in compression forces being applied to both the main and tap portions of the connector. However, during the compression process an unexpected, yet beneficial, distribution of compressive forces occurs. Cross-sections of the crimped connectors (FIGS. 5A–5D) reveal that the minimum and maximum wire sizes for the main groove conductor were essentiality uniformly compressed regardless of the size tap wire being compressed. It is further observed that although the tap portion of the connector received a significantly greater amount of compression distortion than the main portion, the degree of compression of the tap wires was not excessive or detrimental to the function of the connector. An important feature of the present invention is that the smaller wire sizes in the tap portion of the connector are pushed into the area of the tap nearest the main portion creating offset cable lodgment, and the collapsing wall of the tap acts as a filler material to complete the compression.

Figure 5A:
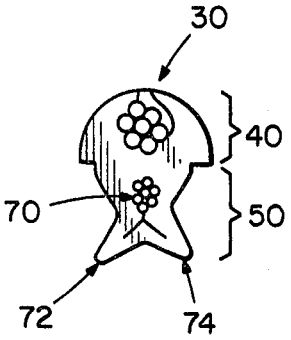
FIGS. 5A–5D are cross-sectional views of the FIG. 4B connector after the connector has been crimped by the FIG. 1 tool onto various size cables.
Figure 5B:
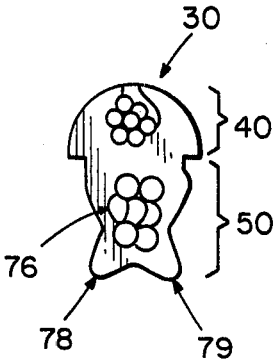
Figure 5C:
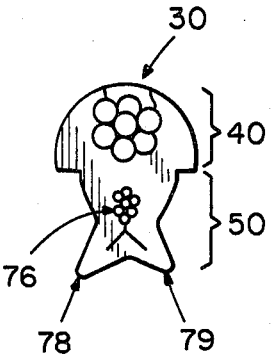
Figure 5D:
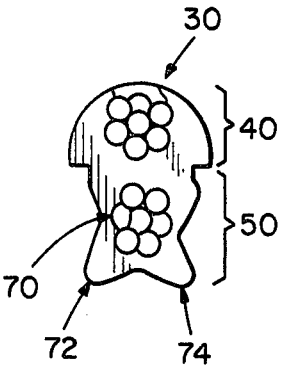

FIGS. 5A–5D show four cross-sectioned views of the compressed connector. FIG. 5A shows the minimum wire sizes in both the main and tap portions of the connector. FIG. 5B shows the minimum wire in the main portion and the maximum wire in the tap portion. FIG. 5C shows the maximum wire in the main portion and the minimum wire in the tap portion. FIG. 5D shows the maximum wire sizes in both the main and tap portions of the connector. FIGS. 5A–5D illustrate the semi-cruciform shape with offset cable lodgment for the tap portion 50, as well as, the semi-circular shape of the main portion 40. In FIGS. 5A–5D it can be seen that the tap cable 70 is offset towards the main portion 40 of the connector 30 and the wall of the tap portion 50 has been deformed and acts as a filler material in areas 72 and 74 between the indentation dies for completion of the compression. The offset of the tap cable occurs also for large size cables, but is not as obvious. The tap cable 76 in FIGS. 5B and 5C is offset toward the main portion 40 and the wall of the tap acts as a filler material in area 78 and 79.

An important aspect of this invention is that the tubular tap portion of the connector can be independently and economically sized, in inside and outside diameters, in relation to the main groove portion and still provide an excellent electrical and mechanical connection in both portions of the connector. The significance of this aspect, is a savings in the amount of metal required to make a connector capable of crimping a significantly larger tap wire to a much smaller main wire, as is often the case when the main wire is a copper conductor and the tap wire is an aluminum wire.

Figure 7:
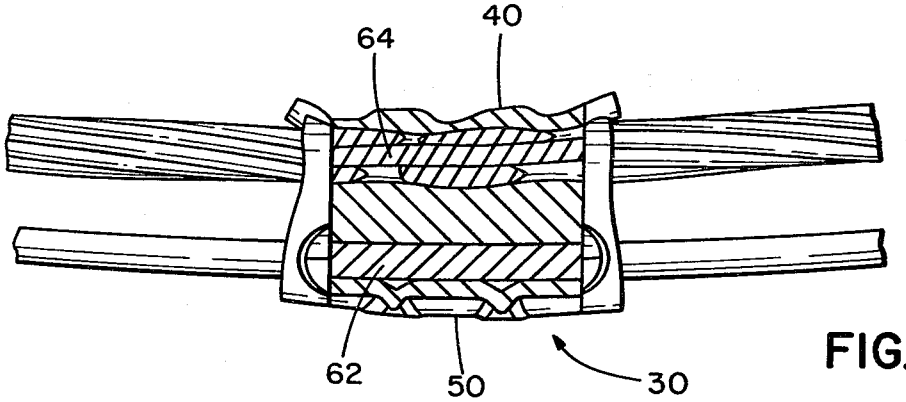
FIG. 7 is a cross-sectional view of the FIG. 6 connector.
Figure 6:
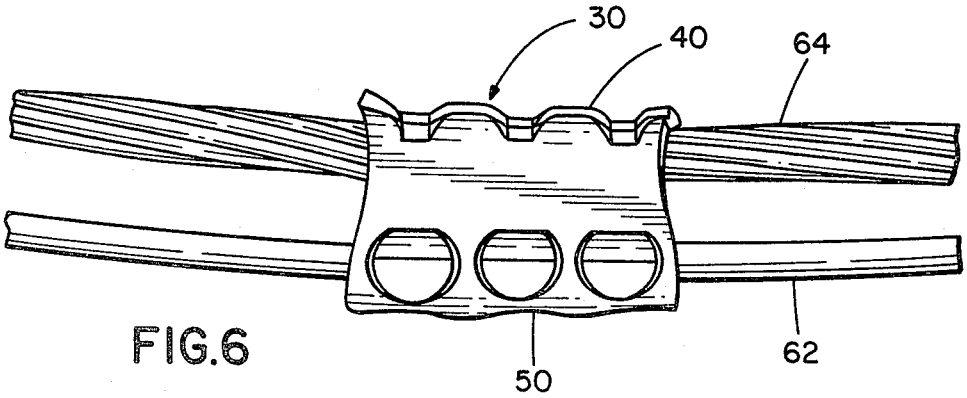
FIG. 6 is a side view of the FIG. 4B connector showing the longitudinal bow which is created by multiple crimps with the FIG. 1 tool.

A further advantage is that of creating a longitudinal bowing of solid hard draw copper wires in the compressed connector grooves, especially in the tap receptacle. This bowing action is illustrated in FIGS. 6 and 7 showing a longitudinal section view of the FIG. 4 connector, and illustrating the bowing of the solid copper tap wire 62 as well as the main cable 64. The advantage of bowing, as well as compressing solid copper wires, is to lessen the tendency of these wires to turn in the connector when torsional forces are applied. Such forces are not uncommon during installation positioning and tightness checks or wind movements. It has been observed that the hard, smooth, and round surface of a solid hard drawn wire is difficult to secure against torque forces when compressed in a soft aluminum alloy connector such as normally used in compression parallel connectors, especially if the wire remains straight, which is often the case in existing state of the art connectors. The bowing of the wires is consistent, unlike prior art devices, and is due to the greater deformation of the tap portion versus the main portion of the connector causing greater elongation of the tap portion which results in a longitudinal bowing of the total connector and conductor mass.

The following is an analysis of known maximum wire ranges of existing simultaneously crimped parallel tap compression connectors compared to the maximum wire ranges of the connectors when the present invention is utilized:

Known maximum wire ranges for connector crimped with existing state of the art tools;
- 0.236" Maximum wire diameter dimensional range of a single groove
- 0.406" Maximum total wire diameter dimensional range of two grooves Actual maximum wire ranges for connectors crimped with the present invention tool;
- 0.359" Maximum wire diameter dimensional range of a single groove
- 0.595" Maximum wire diameter total dimensional range of two grooves in a single connector.

The above analysis serves to illustrate the significant increase in conductor range provided by the present invention, a 52% net increase in conductor range in a single groove of a connector and a 45% net increase in total conductor range in a single connector. Several important advantages are obtained by increasing the wire size range in such a tap connector. Advantages to the user are a savings in installation time resulting from simultaneously crimping the main and tap wires, and the additional convenience of carring a lesser number of connectors with which he is able to connect the varied number of wire size combination to be found from job to job. The manufacturer of such connectors has the economic advantage of manufacturing a greater quantity of fewer individual sizes of connectors as opposed to the less economic condition of manufacturing smaller quantities of more individual sizes of connectors.

A further objective of this invention is to provide such parallel connections as noted above by means of the novel compression method of the present invention, which compresses the connector in such a way as to maintain the requisite goal of limiting the degree of compression of the main conductor so that it is not reduced by more than 10% of its rated tensile strength; yet, allows the tap wires to be compressed to varying degrees of wire deformation, resulting in a significant increase in the wire size range of the tap portion of the connector. It should be noted that the tap portion of these connectors are not subject to the above stated main conductor tensile strength requirements.

The invention is not limited to the particular details of the method and appartus depicted and other modifications and applications are contemplated. Certain other changes may be made in the above-described method and apparatus without departing from the true spirit and scope of the invention herein involved. It is intended therefore that the subject matter in the above depiction shall be interpreted as illustrative and not in a limiting sense.

What is claimed is:

1. An elongated malleable metal connector for electrically and mechanically connecting two cables or the like and for use with a crimping tool having first and second opposed pairs of crimping dies, said connector comprising:

a U-shaped main portion having two legs, a first leg of said two legs having a hinged segment for closing the opening created by the U-shape of said main portion, said hinged segment initially being open, said hinge segment being manually closed after transverse insertion of one of a number of different size cables, and a tap portion capable of being deformed to a semi-cruciform transverse cross-section with offset cable lodgment and for receiving one of a number of different size cables, said tap portion being attached to said main portion along the bottom of said U-shaped main portion, the axis of said tap portion being parallel to the axis of said main portion, said tap portion including a bifurcated body member having first and second leg portions, the outer surface of said first leg portion being attached to the bottom of said U-shaped main portion, said first and second leg portions being initially connected by a reduced cross-sectional thickness portion of said body member to provide a plastically flowable hinge connection, said first and second leg portions defining an initial predetermined angle such that said body member can laterally engage an uninsulated section of an electrical cable;

said first leg having on the end opposite said reduced thickness portion an axially extending rib member and axially extending inner and outer ridges disposed on either side of said rib member;

said second leg having on the end opposite said reduced thickness portion axially extending inner and outer fingers, said rib member, said inner and outer ridges and said inner and outer fingers being oriented such that said outer finger lies between said outer ridge and said rib member, and said inner finger lies between said inner ridge and said rib member, when said body member is closed about an uninsulated section of the cable, said enclosure occuring by pivoting of said legs about said reduced thickness portion in response to hand applied external pressure; and whereby, said inner and outer fingers and said rib members are deformed to form a positive mechanical lock when said connector is placed between the first and second opposed pairs of crimping dies, and said dies are moved simultaneously converging radially toward one another, said first pair, each having a nose portion, bites into said tap portion of said connector and one of said second pair, having a nose portion, also bites into said tap portion of said connector, and the other of said second pair, having a nest die, crimps and main portion of said connector.

* * * * *